US009951774B2

(12) United States Patent
Komai et al.

(10) Patent No.: US 9,951,774 B2
(45) Date of Patent: Apr. 24, 2018

(54) LUBRICATION OF A ROTARY COMPRESSOR

(71) Applicant: FUJITSU GENERAL LIMITED, Kawasaki-shi, Kanagawa (JP)

(72) Inventors: Yuji Komai, Kawasaki (JP); Naoya Morozumi, Kawasaki (JP); Shingo Yahaba, Kawasaki (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 182 days.

(21) Appl. No.: 14/897,075

(22) PCT Filed: Jan. 29, 2014

(86) PCT No.: PCT/JP2014/051979

§ 371 (c)(1),
(2) Date: Dec. 9, 2015

(87) PCT Pub. No.: WO2015/033586

PCT Pub. Date: Mar. 12, 2015

(65) Prior Publication Data

US 2016/0131137 A1 May 12, 2016

(30) Foreign Application Priority Data

Sep. 6, 2013 (JP) ..... 2013-185722

(51) Int. Cl.

| | |
|---|---|
| ***F04C 29/02*** | (2006.01) |
| ***F04C 29/00*** | (2006.01) |
| ***F04C 18/356*** | (2006.01) |
| ***F04C 23/00*** | (2006.01) |

(52) U.S. Cl.

CPC ..... *F04C 29/023* (2013.01); *F04C 18/3564* (2013.01); *F04C 23/001* (2013.01); (Continued)

(58) Field of Classification Search

CPC ..... F04C 29/023; F04C 29/025
See application file for complete search history.

(56) References Cited

U.S. PATENT DOCUMENTS 4,640,669 A * 2/1987 Gannaway ..... F04C 29/023 184/6.16
4,710,111 A * 12/1987 Kubo ..... F04C 29/023 184/6.16

(Continued)

FOREIGN PATENT DOCUMENTS

CN 102734168 A 10/2012
CN 102734171 A 10/2012

(Continued)

OTHER PUBLICATIONS

First Office Action dated Jul. 5, 2016, issued in corresponding Chinese Patent Application No. 201480025092.7, (5 pgs).

(Continued)

*Primary Examiner* — Mary A Davis
(74) *Attorney, Agent, or Firm* — McDermott Will & Emery LLP

(57) ABSTRACT

A rotary compressor includes: a vertically-positioned air-tight compressor housing, in an upper section of which a discharge unit of a refrigerant is provided and in a lower section of which an inlet unit of the refrigerant is provided and lubricant oil is stored; and a lubricating mechanism supplying lubricant oil stored in the lower section of the compressor housing to a sliding portion of a compressing unit through a vertical lubricating hole and a horizontal lubricating hole of a rotation shaft. The horizontal lubricating hole of the lubricating mechanism is formed between the same direction as an eccentric direction of an eccentric portion provided on the rotation shaft and causes an annular piston of the compressing unit making an orbital motion in a cylinder and a 80° phase shifted direction from the same direction as the eccentric direction in a direction opposite to a rotation direction of the rotation shaft.

3 Claims, 12 Drawing Sheets

(52) U.S. Cl.
CPC ..... *F04C 23/008* (2013.01); *F04C 29/0085* (2013.01); *F04C 29/025* (2013.01)

(56) References Cited

U.S. PATENT DOCUMENTS

| | | | |
|---|---|---|---|
| 7,438,541 | B2 | 10/2008 | Aya et al. |
| 2010/0180628 | A1 | 7/2010 | Hasegawa et al. |
| 2012/0141312 | A1 | 6/2012 | Lee et al. |
| 2012/0174620 | A1 | 7/2012 | Takashima et al. |

FOREIGN PATENT DOCUMENTS

| | | | |
|---|---|---|---|
| EP | 0182993 | A1 | 6/1986 |
| EP | 2489879 | A1 | 8/2012 |
| JP | 2001073977 | A | 3/2001 |
| JP | 2004019506 | A | 1/2004 |
| JP | 2007-138955 | A | 6/2007 |
| JP | 5014346 | B2 | 8/2012 |

OTHER PUBLICATIONS

Extended European Search Report EP Application No. 14842888.1 dated Apr. 25, 2017.
First Office Action issued in corresponding Australian Patent Application No. 2014316483 dated Sep. 29, 2016.
International Search Report dated May 13, 2014, received in related International Application No. PCT/JP2014/051979, filed Jan. 29, 2014 (translation is provided).

* cited by examiner

[FIG. 1]
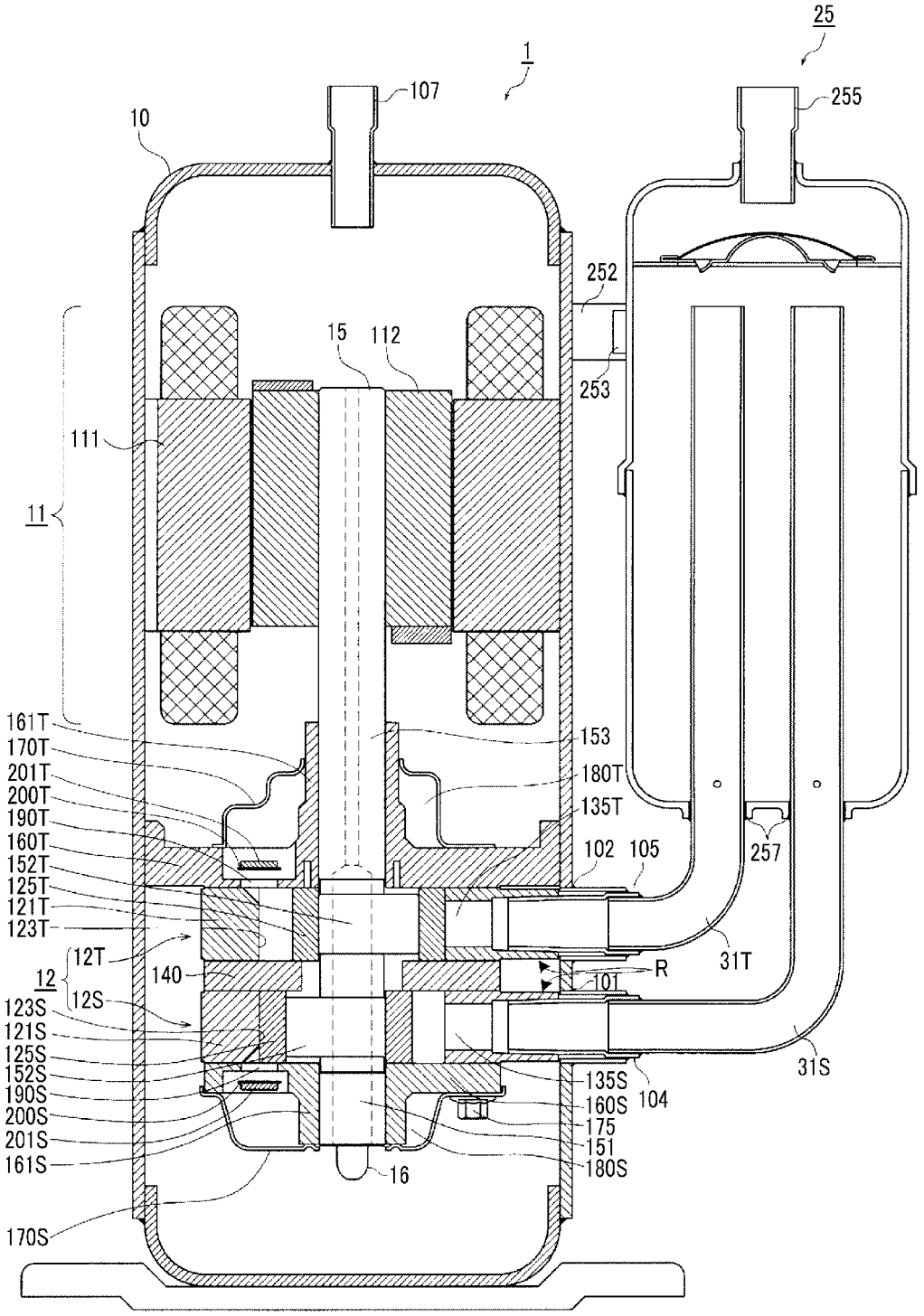

[FIG. 2]
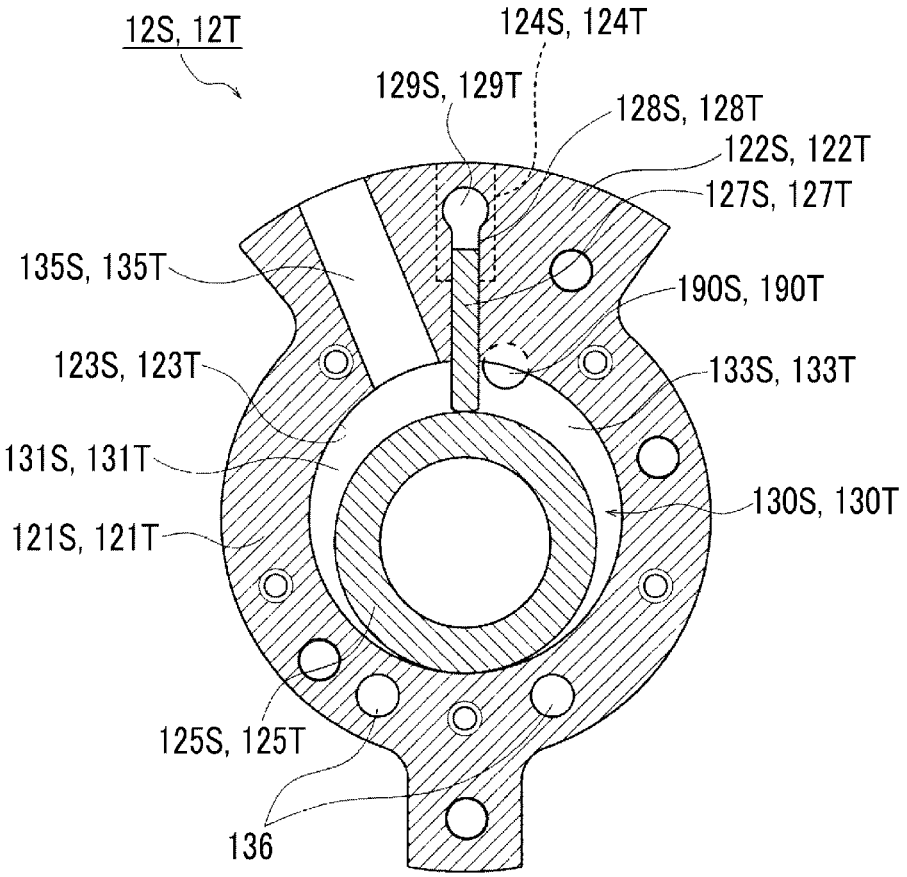

[FIG. 3]
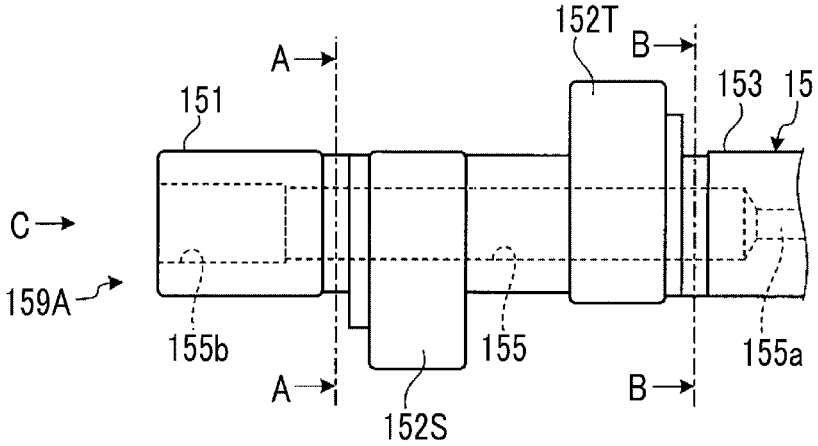

[FIG. 4]
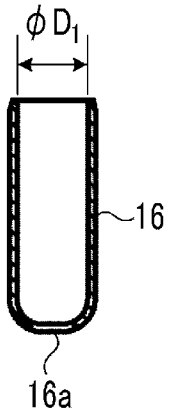
[FIG. 5]
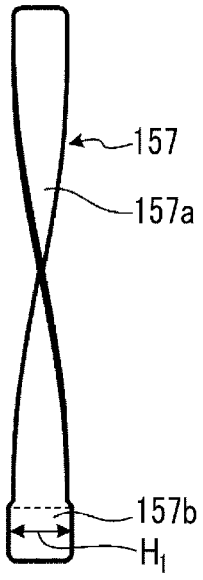

[FIG. 6-1]
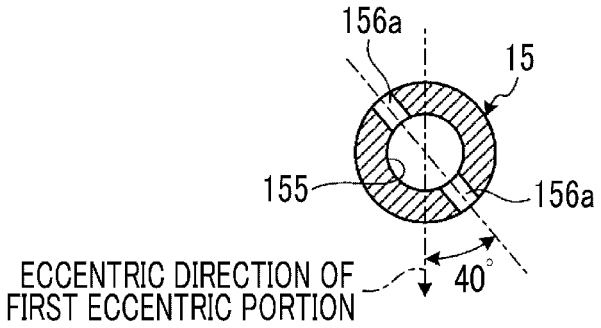
[FIG. 6-2]
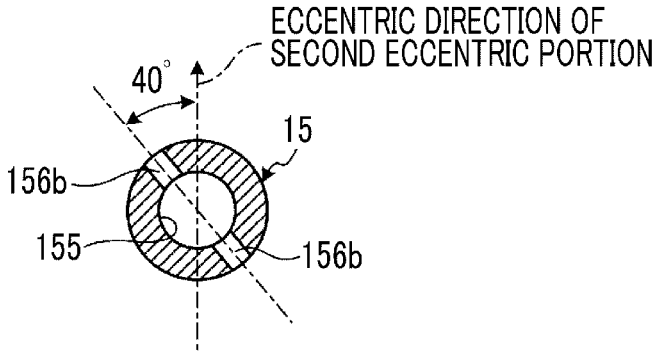

[FIG. 7]
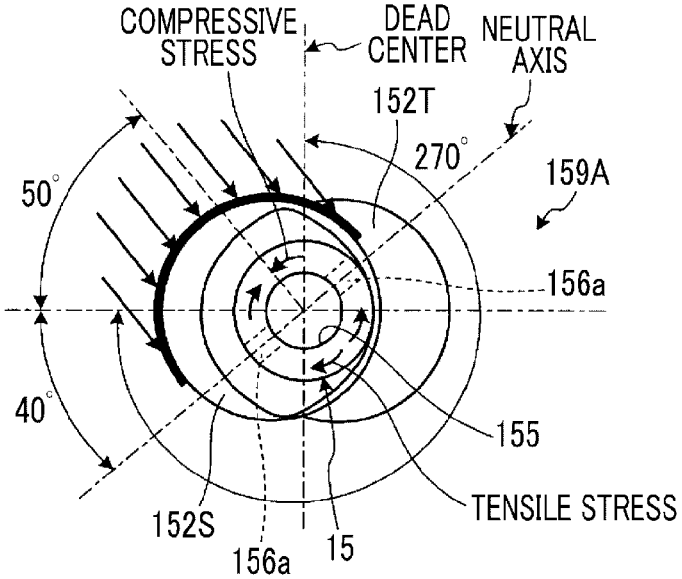
[FIG. 8]
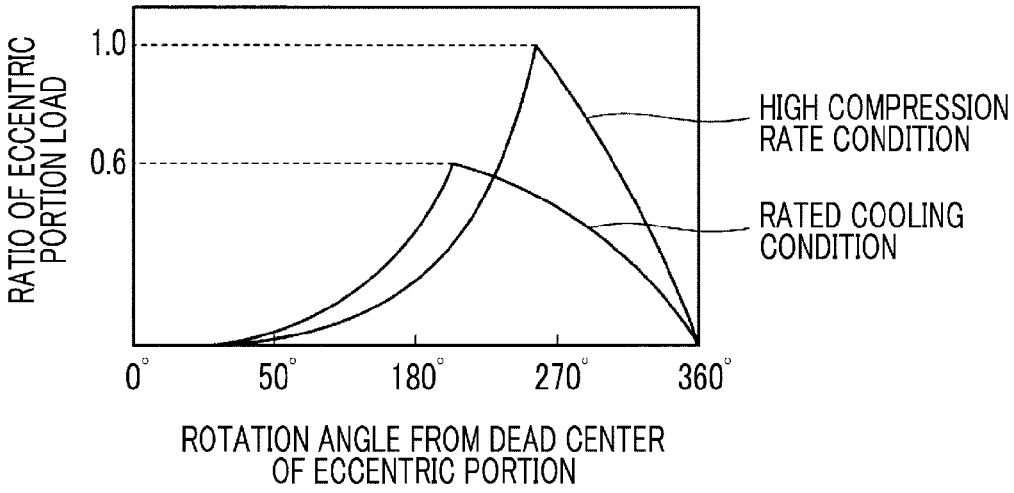

[FIG. 9]
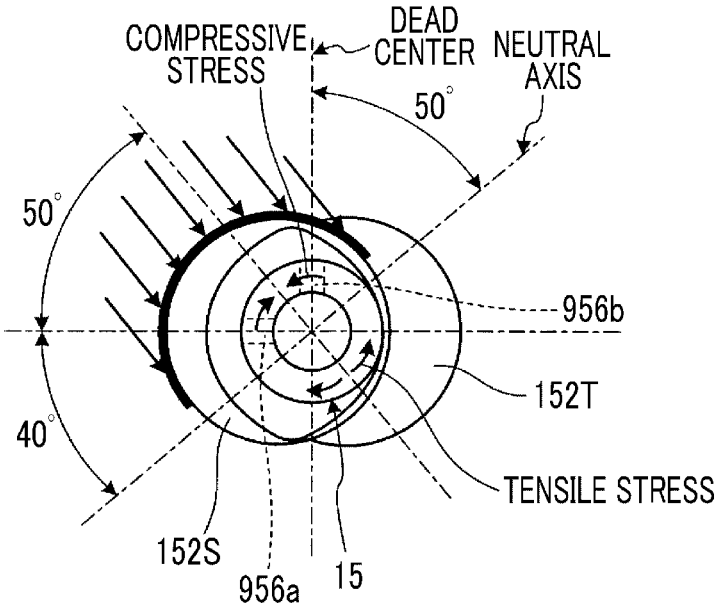
[FIG. 10]
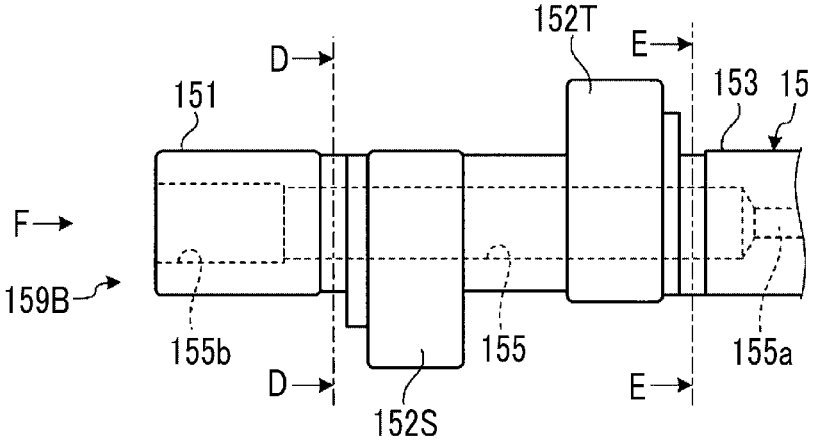

[FIG. 11-1]
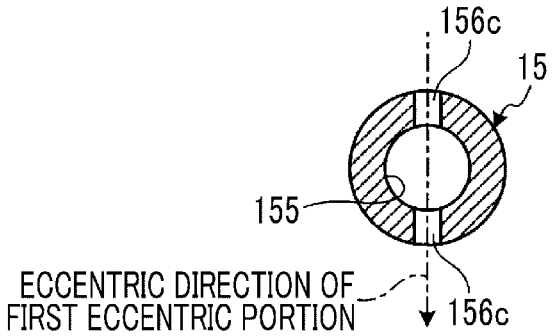
[FIG. 11-2]
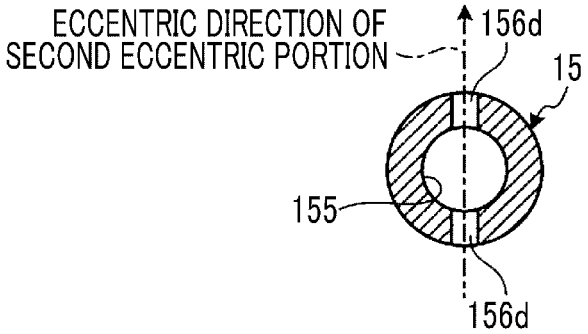

[FIG. 12]
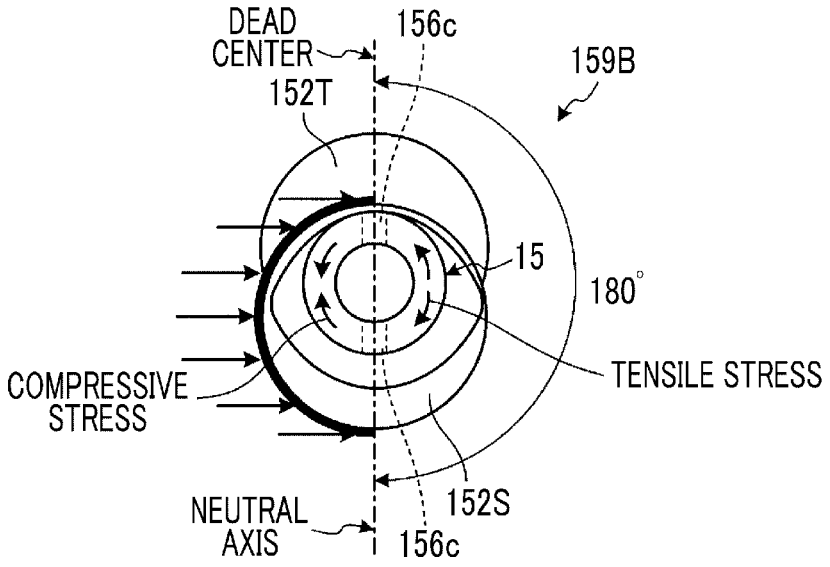
[FIG. 13]
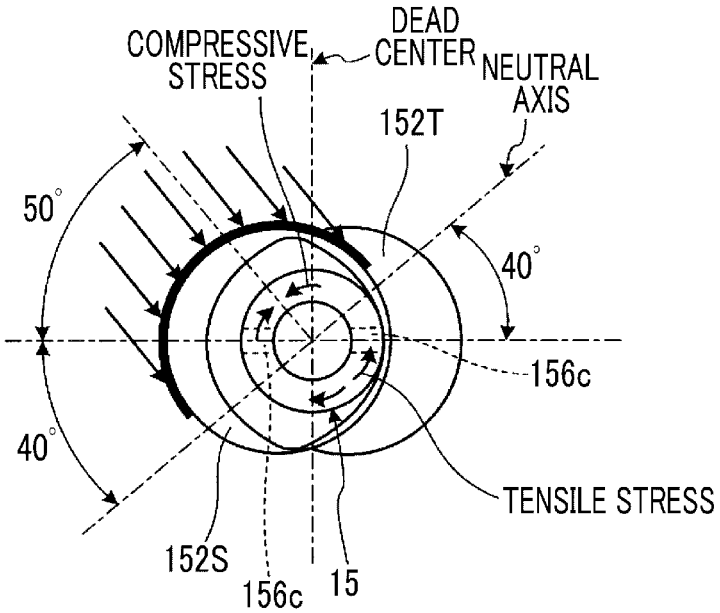

[FIG. 14]
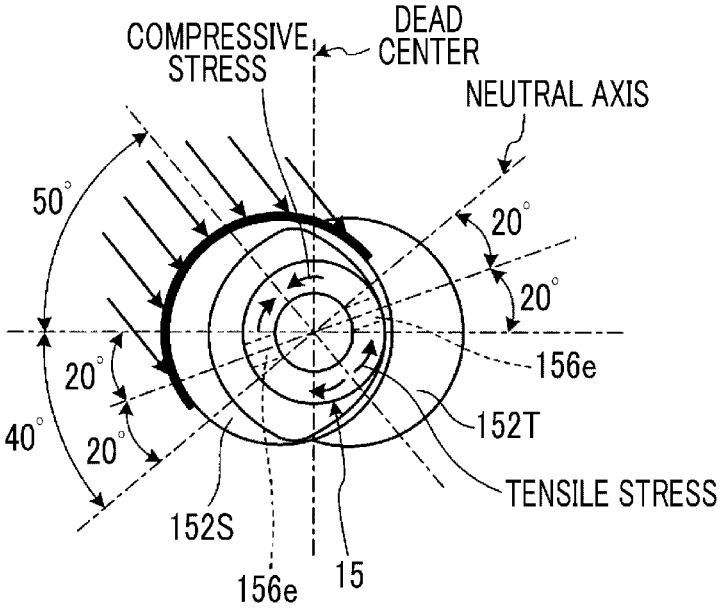
[FIG. 15]
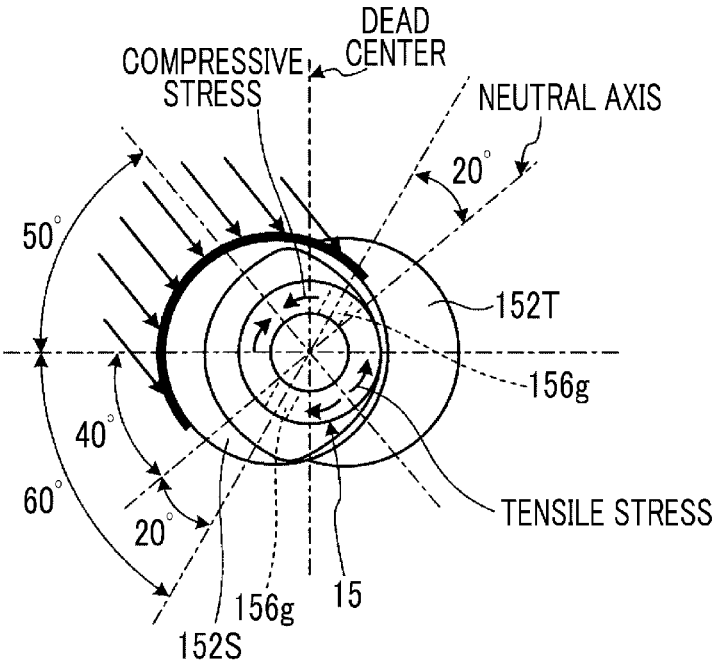

[FIG. 16]
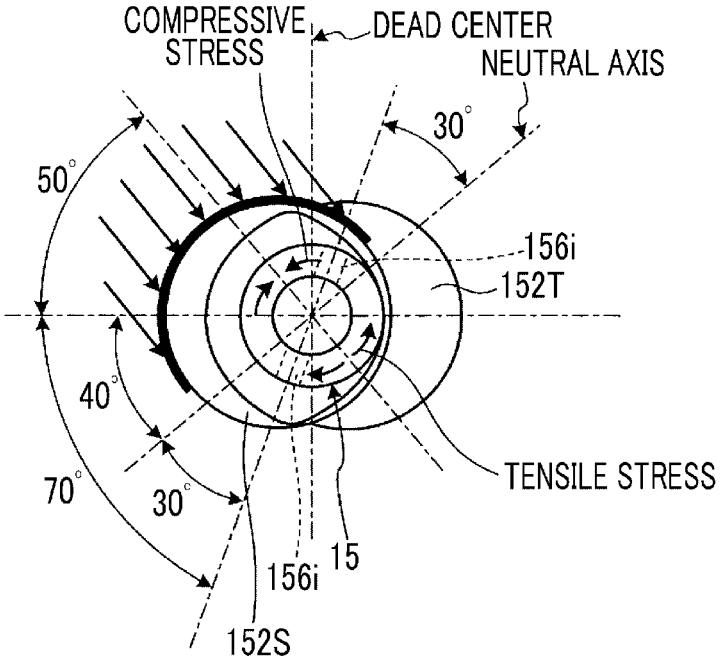
[FIG. 17]
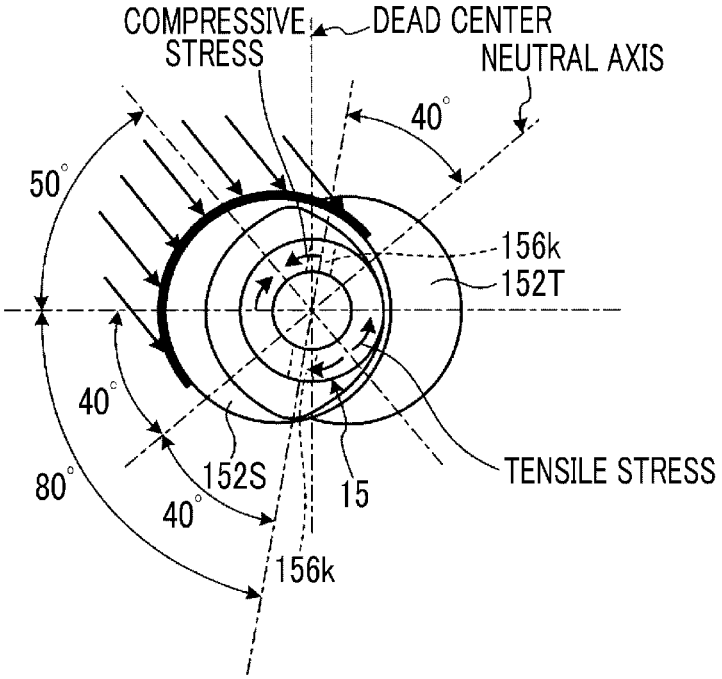

[FIG. 18]
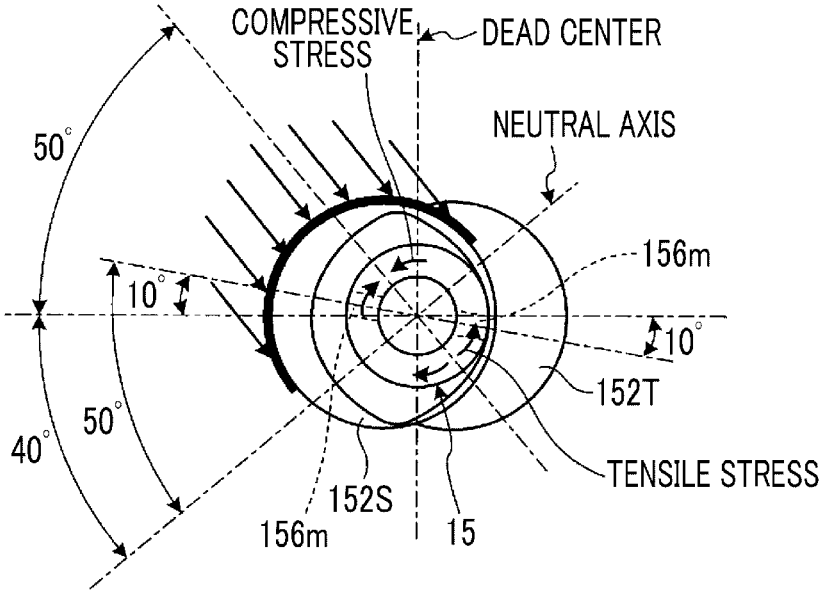

LUBRICATION OF A ROTARY COMPRESSOR

CROSS-REFERENCE

This application is the U.S. National Phase under 35 U.S.C. § 371 of International Application No. PCT/JP2014/051979, filed Jan. 29, 2014, which claims the benefit of Japanese Application No. 2013-185722, filed Sep. 6, 2013, the entire contents of each are hereby incorporated by reference.

TECHNICAL FIELD

The present invention relates to a rotary compressor that is used in an air conditioner or a refrigerating machine.

BACKGROUND ART

In the related art, an airtight rotary compressor is disclosed which includes an electric motor element and a rotary compression element that is connected to the electric motor element via a drive shaft in an airtight container and further includes a lubricating mechanism that lubricates a sliding unit of the rotary compression element with lubricant oil accumulated on the bottom of the airtight container. The rotary compression element has two bearings that support the drive shaft and a cylinder provided between the bearings. The drive shaft has an eccentric portion that causes a roller fit inside the cylinder to perform an orbital motion and a through hole that has at least a portion which allows the lubricant oil to pass through an outer side thereof and a refrigerant gas leaked to an inner circumferential side of the roller to pass through an inner side thereof. Pressure inside the airtight container is equal to or lower than a discharge pressure and a plurality of horizontal holes are provided toward an outer circumferential surface of the drive shaft from the through hole. Each of the horizontal holes functions as either a lubricating passage or a gas passage and the plurality of horizontal holes toward the outer circumferential surface of the drive shaft from the through hole are shifted from each other by 90° and are provided on a side of the drive shaft on which compressive stress acts (for example, see PTL 1).

CITATION LIST

Patent Literature

PTL 1: JP-A-2004-19506

SUMMARY OF INVENTION

Technical Problem

However, according to a technology in the related art, in a case where a drive shaft is small in diameter, a distance between horizontal holes which are spaced apart by 90° is small even when a plurality of the horizontal holes are provided on a side of the drive shaft on which compressive stress acts. Therefore, a problem arises in that the drive shaft becomes low in strength. In addition, in a case where both of the horizontal holes are used as lubricating passages, lubrication is not performed in a zone of 270° of one rotation of the drive shaft when the holes are spaced apart by 90°. Therefore, a problem arises in that the lubrication is intermittently performed and thus, lubrication performance deteriorates. In addition, a process of drilling the holes which are spaced apart by 90° has to be performed by rotating the drive shaft by 90°. Therefore, a problem arises in that a cost of the process is high.

The present invention is performed by taking the above problems into account and has an object to achieve a rotary compressor in which strength of a drive shaft (rotation shaft) can be secured and a sliding unit is not intermittently lubricated and which includes the drive shaft of which a processing cost is not high.

Solution to Problem

In order to solve the above problems and to achieve the object, a rotary compressor of the present invention includes: a vertically-positioned airtight compressor housing, in an upper section of which a discharge unit of a refrigerant is provided and in a lower section of which an inlet unit of the refrigerant is provided and lubricant oil is stored; a compressing unit that is disposed in the lower section of the compressor housing and that compresses the refrigerant sucked in via the inlet unit and discharges the refrigerant from the discharge unit; a motor that is disposed in the upper section of the compressor housing and drives the compressing unit via a rotation shaft; and a lubricating mechanism that supplies the lubricant oil stored in the lower section of the compressor housing to a sliding portion of the compressing unit through a vertical lubricating hole and a horizontal lubricating hole of the rotation shaft. Here, the horizontal lubricating hole of the lubricating mechanism is formed between the same direction as an eccentric direction of an eccentric portion that is provided on the rotation shaft and causes an annular piston of the compressing unit to make an orbital motion in a cylinder and a 80° phase shifted direction from the same direction as the eccentric direction in a direction opposite to a rotation direction of the rotation shaft.

Advantageous Effects of Invention

According to effects of the present invention, a rotary compressor that includes a rotation shaft of which strength is secured and a processing cost is low can be achieved.

BRIEF DESCRIPTION OF DRAWINGS

FIG. 1 is a vertical cross-sectional view illustrating an example of a rotary compressor according to the present invention.

FIG. 2 is a horizontal cross-sectional view of first and second compressing units according to the example when viewed from above.

FIG. 3 is a side view of a lower section of a rotation shaft of Example 1.

FIG. 4 is a vertical cross-sectional view of a lubricating pipe of Example 1.

FIG. 5 is a side view of a pump blade of Example 1.

FIG. 6-1 is a cross-sectional view from below taken along line A-A in FIG. 3.

FIG. 6-2 is a cross-sectional view from below taken along line B-B in FIG. 3.

FIG. 7 is a view from below along arrow C in FIG. 3 and a view illustrating an acting state of a refrigerant compressive load on a rotation shaft when a rotation angle of an eccentric portion of the rotation shaft becomes 270°.

FIG. 8 is a view illustrating a relationship between a rotation angle of the eccentric portion of the rotation shaft and a refrigerant compressive load.

FIG. 9 is a view illustrating an acting state of a refrigerant compressive load on a rotation shaft of a rotary compressor in the related art which is disclosed in PTL 1 when a rotation angle of an eccentric portion of the rotation shaft becomes 270°.

FIG. 10 is a side view of a lower section of a rotation shaft of Example 2.

FIG. 11-1 is a cross-sectional view from below taken along line D-D in FIG. 9.

FIG. 11-2 is a cross-sectional view from below taken along line E-E in FIG. 9.

FIG. 12 is a view from below along arrow F in FIG. 10 and a view illustrating an acting state of a refrigerant compressive load on the rotation shaft when a rotation angle of an eccentric portion of the rotation shaft becomes 180°.

FIG. 13 is a view from below along arrow F in FIG. 10 and a view illustrating an acting state of a refrigerant compressive load on the rotation shaft when a rotation angle of the eccentric portion of the rotation shaft becomes 270°.

FIG. 14 is a view illustrating positions of horizontal lubricating holes of Example 3.

FIG. 15 is a view illustrating positions of horizontal lubricating holes of Example 4.

FIG. 16 is a view illustrating positions of horizontal lubricating holes of Example 5.

FIG. 17 is a view illustrating positions of horizontal lubricating holes of Example 6.

FIG. 18 is a view illustrating positions of horizontal lubricating holes of Example 7.

DESCRIPTION OF EMBODIMENTS

Hereinafter, an example of a rotary compressor according to the present invention will be described in detail based on the drawings. The invention is not limited to the example.

EXAMPLE 1

FIG. 1 is a vertical cross-sectional view illustrating an example of a rotary compressor according to the present invention. FIG. 2 is a horizontal cross-sectional view of first and second compressing units according to the example when viewed from above.

As illustrated in FIG. 1, a rotary compressor 1 of the example includes a compressing unit 12 that is disposed in the lower section of a vertically-positioned airtight compressor housing 10 which has a cylindrical shape and a motor 11 that is disposed in the upper section of the compressor housing 10 and drives the compressing unit 12 via a rotation shaft 15.

A stator 111 of the motor 11 is formed in a cylindrical shape and is shrink-fitted and fixed in the inner circumferential surface of the compressor housing 10. A rotor 112 of the motor 11 is disposed inside the cylindrical stator 111 and is shrink-fitted and fixed to the rotation shaft 15 that mechanically connects the motor 11 with the compressing unit 12.

The compressing unit 12 includes a first compressing section 12S and a second compressing section 12T that is disposed in parallel with the first compressing section 12S and is stacked on the first compressing section 12S. As illustrated in FIG. 2, the first and second compressing units 12S and 12T include annular first and second cylinders 121S and 121T in which first and second inlet holes 135S and 135T that are radially disposed and first and second vane grooves 128S and 128T are provided in first and second side-flared portions 122S and 122T.

As illustrated in FIG. 2, circular first and second cylinder inner walls 123S and 123T are formed in the first and second cylinders 121S and 121T so as to be concentric with the rotation shaft 15 of the motor 11. First and second annular pistons 125S and 125T which have an outer diameter smaller than an inner diameter of the cylinder are provided inside the first and second cylinder inner walls 123S and 123T, respectively. First and second operation chambers 130S and 130T which suck in, compress, and discharge a refrigerant gas are formed between the first and second cylinder inner walls 123S and 123T and the first and second annular pistons 125S and 125T.

The first and second vane grooves 128S and 128T are formed over the entire cylinder height of the first and second cylinders 121S and 121T in a radial direction from the first and second cylinder inner walls 123S and 123T. First and second vanes 127S and 127T, each of which has a plate shape, are slidably fit in the first and second vane grooves 128S and 128T.

As illustrated in FIG. 2, first and second spring bores 124S and 124T are formed in a deep portion of the first and second vane grooves 128S and 128T such that communication from the outer circumferential portions of the first and second cylinders 121S and 121T to the first and second vane grooves 128S and 128T is performed. First and second vane springs (not illustrated) which press the back surface of the first and second vanes 127S and 127T are inserted into the first and second spring bores 124S and 124T.

When the rotary compressor 1 is started, the first and second vanes 127S and 127T protrude from the inside of the first and second vane grooves 128S and 128T to the inside of the first and second operation chambers 130S and 130T due to bounces of the first and second vane springs and ends of the vanes come into contact with the outer circumferential surfaces of the first and second annular pistons 125S and 125T. Then, the first and second vanes 127S and 127T partition the first and second operation chambers 130S and 130T into first and second inlet chambers 131S and 131T and first and second compression chambers 133S and 133T.

In addition, the refrigerant gas compressed in the compressor housing 10 is guided into the first and second cylinders 121S and 121T by communicating the deep portion of the first and second vane grooves 128S and 128T with the inside of the compressor housing 10 via an opening R illustrated in FIG. 1. First and second pressure guiding-in paths 129S and 129T which cause back pressures to be applied by the pressure of the refrigerant gas are formed in the first and second vanes 127S and 127T.

The first and second inlet holes 135S and 135T which cause the first and second inlet chambers 131S and 131T to communicate with the outside are provided in the first and second cylinders 121S and 121T such that a refrigerant is sucked into the first and second inlet chambers 131S and 131T from the outside.

In addition, as illustrated in FIG. 1, an intermediate partition plate 140 is disposed between the first cylinder 121S and the second cylinder 121T and partitions and closes the first operation chamber 130S (refer to FIG. 2) of the first cylinder 121S from the second operation chamber 130T (refer to FIG. 2) of the second cylinder 121T. A lower end plate 160S is disposed on a lower end portion of the first cylinder 121S and closes the first operation chamber 130S of the first cylinder 121S. In addition, an upper end plate 160T is disposed on an upper end portion of the second cylinder 121T and closes the second operation chamber 130T of the second cylinder 121T.

A sub-bearing unit 161S is formed on the lower end plate 160S and a sub-shaft unit 151 of the rotation shaft 15 is rotatably supported in the sub-bearing unit 161S. A main-bearing unit 161T is formed on the upper end plate 160T and a main-shaft unit 153 of the rotation shaft 15 is rotatably supported in the main-bearing unit 161T.

The rotation shaft 15 includes a first eccentric portion 152S and a second eccentric portion 152T which are eccentric by a 180° phase shift from each other. The first eccentric portion 152S is rotatably fit in the first annular piston 125S of the first compressing unit 12S. The second eccentric portion 152T is rotatably fit in the second annular piston 125T of the second compressing unit 12T.

When the rotation shaft 15 rotates, the first and second annular pistons 125S and 125T make orbital motions inside the first and second cylinders 121S and 121T along the first and second cylinder inner walls 123S and 123T in a counterclockwise direction in FIG. 2. Accordingly, the first and second vanes 127S and 127T perform reciprocal motions. The motions of the first and second annular pistons 125S and 125T and the first and second vanes 127S and 127T cause volumes of the first and second inlet chambers 131S and 131T and the first and second compression chambers 133S and 133T to be continually changed. In this manner, the compressing unit 12 continually sucks in, compresses, and discharges the refrigerant gas.

As illustrated in FIG. 1, a lower muffler cover 170S is disposed on the lower side of the lower end plate 160S and a lower muffler chamber 180S is formed between the lower endplate 160S and the lower muffler cover 170S. The first compressing unit 12S opens to the lower muffler chamber 180S. That is, a first outlet 190S (refer to FIG. 2) through which the first compression chamber 133S of the first cylinder 121S communicates with the lower muffler chamber 180S is provided in the vicinity of the first vane 127S of the lower end plate 160S. In addition, a first discharge valve 200S which prevents the compressed refrigerant gas from flowing backward is disposed in the first outlet 190S.

The lower muffler chamber 180S is a single annular chamber. The lower muffler chamber 180S is a part of a communication path through which a discharge side of the first compressing unit 12S communicates with the inside of the upper muffler chamber 180T bypassing through a refrigerant path 136 (refer to FIG. 2) which penetrates the lower end plate 160S, the first cylinder 121S, the intermediate partition plate 140, the second cylinder 121T and the upper end plate 160T. Further, the lower muffler chamber 180S causes pressure pulsation of the discharged refrigerant gas to be reduced. In addition, a first discharge valve cover 201S which controls an amount of flexural valve opening of the first discharge valve 200S is stacked on the first discharge valve 200S and is fixed to the first discharge valve 200S using a rivet. The first outlet 190S, the first discharge valve 200S, and the first discharge valve cover 201S configure a first discharge valve unit of the lower end plate 160S.

As illustrated in FIG. 1, an upper muffler cover 170T is disposed on the upper side of the upper end plate 160T and an upper muffler chamber 180T is formed between the upper end plate 160T and the upper muffler cover 170T. A second outlet 190T (refer to FIG. 2) through which the second compression chamber 133T of the second cylinder 121T communicates with the upper muffler chamber 180T is provided in the vicinity of the second vane 127T of the upper end plate 160T. A reed valve type second discharge valve 200T which prevents the compressed refrigerant gas from flowing backward is disposed in the second outlet 190T. In addition, a second discharge valve cover 201T which controls an amount of flexural valve opening of the second discharge valve 200T is stacked on the second discharge valve 200T and is fixed using a rivet with the second discharge valve 200T. The upper muffler chamber 180T causes pressure pulsation of discharged refrigerant to be reduced. The second outlet 190T, the second discharge valve 200T, and the second discharge valve cover 201T configure a second discharge valve unit of the upper end plate 160T.

The first cylinder 121S, the lower end plate 160S, the lower muffler cover 170S, the second cylinder 121T, the upper end plate 160T, the upper muffler cover 170T, and the intermediate partition plate 140 are integrally fastened using a plurality of penetrating bolts 175 or the like. The outer circumferential portion of the upper end plate 160T of the compressing unit 12 which is integrally fastened using the penetrating bolts 175 or the like is firmly fixed to the compressor housing 10 through spot welding such that the compressing unit 12 is fixed to the compressor housing 10.

First and second through holes 101 and 102 are provided in the outer-side wall of the cylindrical compressor housing 10 at an interval in an axial direction in this order from a lower section thereof so as to communicate with first and second inlet pipes 104 and 105, respectively. In addition, outside the compressor housing 10, an accumulator 25 which is formed of a separate airtight cylindrical container is held by an accumulator holder 252 and an accumulator band 253.

A system connecting pipe 255 which is connected to an evaporator in a refrigeration cycle is connected at the center of the top portion of the accumulator 25. First and second low-pressure communication tubes 31S and 31T, each of which has one end extending toward the upward side inside the accumulator 25, and which have the other ends connected to the other end of each of the first and second inlet pipes 104 and 105, are connected to a bottom through hole 257 provided in the bottom of the accumulator 25.

The first and second low-pressure communication tubes 31S and 31T which guide a low pressure refrigerant in the refrigeration cycle to the first and second compressing units 12S and 12T via the accumulator 25 are connected to the first and second inlet holes 135S and 135T (refer to FIG. 2) of the first and second cylinders 121S and 121T via the first and second inlet pipes 104 and 105 as an inlet unit. That is, the first and second inlet holes 135S and 135T are connected to the evaporator of the refrigeration cycle in parallel.

A discharge pipe 107 as a discharge unit which is connected to the refrigeration cycle and discharges a high pressure refrigerant gas to a side of a condenser in the refrigeration cycle is connected to the top portion of the compressor housing 10. That is, the first and second outlets 190S and 190T are connected to the condenser in the refrigeration cycle.

Lubricant oil is sealed in the compressor housing 10 substantially to the elevation of the second cylinder 121T. In addition, the lubricant oil is sucked up from a lubricating pipe 16 attached to the lower end portion of the rotation shaft 15, using a pump blade 157 (refer to FIG. 5) to be described below which is inserted into the lower section of the rotation shaft 15. The lubricant oil circulates through the compressing unit 12, lubricates sliding components, and seals a fine gap in the compressing unit 12.

Next, a lubricating mechanism of Example 1 which is a characteristic configuration of the rotary compressor of the example will be described with reference to FIG. 3 to FIG.

8. FIG. 3 is a side view of a lower section of a rotation shaft of Example 1. FIG. 4 is a vertical cross-sectional view of a lubricating pipe of Example 1. FIG. 5 is a side view of a pump blade of Example 1. FIG. 6-1 is a cross-sectional view from below taken along line A-A in FIG. 3. FIG. 6-2 is a cross-sectional view from below taken along line B-B in FIG. 3. FIG. 7 is a view from below along arrow C in FIG. 3 and a view illustrating an acting state of a refrigerant compressive load on a rotation shaft when a rotation angle of an eccentric portion of the rotation shaft becomes 270°. FIG. 8 is a view illustrating a relationship between the rotation angle of the eccentric portion of the rotation shaft and a refrigerant compressive load.

As illustrated in FIG. 3, FIG. 6-1, and FIG. 6-2, a vertical fitting hole 155*b*, vertical lubricating holes 155 and 155*a*, in this order from the lower section, and first and second horizontal lubricating holes 156*a* and 156*b* which supply the lubricant oil to the compressing unit 12 (refer to FIG. 1) from the vertical lubricating hole 155 are provided in the rotation shaft 15. The vertical fitting hole 155*b* is formed to have an inner diameter greater than the inner diameter of the vertical lubricating hole 155.

As illustrated in FIG. 4, the lubricating pipe 16 is manufactured using a soft material such as copper or aluminum, has an inlet 16*a* on the lower end thereof, and is opened at the upper end thereof. As illustrated in FIG. 5, the pump blade 157 is made of a metal plate and has a blade portion 157*a* and a base portion 157*b* that is formed to be wider than the blade portion 157*a*. The blade portion 157*a* is subjected to a twisting process and has a 180°-twisted shape.

When the lubricating pipe 16 and the pump blade 157 are assembled into the rotation shaft 15, first, the base portion 157*b* of the pump blade 157 is pressed against and fixed to the lower section inside the lubricating pipe 16. A horizontal width $H_1$ of the base portion 157*b* has a size relationship ($H_1 > \varphi D_1$) of an interference fit with the inner diameter $\varphi D_1$ of the lubricating pipe 16 and the pump blade 157 is fixed to the lubricating pipe 16.

Next, the blade portion 157*a* of the pump blade 157 is inserted into the vertical lubricating hole 155 of the rotation shaft 15 and the upper portion of the lubricating pipe 16 is pressed into the vertical fitting hole 155*b* and the fit lubricating pipe 16 is fixed to the rotation shaft 15. The length of the lubricating pipe 16 is substantially twice the depth of the vertical fitting hole 155*b* of the rotation shaft 15. The lower section of the lubricating pipe 16 protrudes toward the downward side from the vertical fitting hole 155*b*.

As illustrated in FIG. 3, FIG. 6-1, and FIG. 7, the first horizontal lubricating holes 156*a* of a lubricating mechanism 159A of Example 1 are formed on a side of the sub-shaft unit 151 of the first eccentric portion 152S of the rotation shaft 15. In addition, the first horizontal lubricating holes 156*a* are formed as a horizontal through hole of the rotation shaft 15 in a 40° phase shifted direction from an eccentric direction (downward side in FIG. 3 and FIG. 6-1 and left side in FIG. 7) of the first eccentric portion 152S in a direction opposite to the rotating direction (clockwise direction in FIG. 6-1 and FIG. 7 because the views are seen from below) of the rotation shaft 15.

As illustrated in FIG. 3 and FIG. 6-2, the second horizontal lubricating holes 156*b* of the lubricating mechanism 159A of Example 1 are formed on a side of the main-shaft unit 153 of the second eccentric portion 152T of the rotation shaft 15. In addition, the second horizontal lubricating holes 156*b* are formed as a horizontal through hole of the rotation shaft 15 in a 40° phase shifted direction from an eccentric direction (upward side in FIG. 3 and FIG. 6-2) of the second eccentric portion 152T in a direction opposite to the rotating direction (clockwise direction in FIG. 6-2 because the view is seen from below) of the rotation shaft 15.

Horizontal lubricating holes in the related art are formed in directions orthogonal to the eccentric directions of the first and second eccentric portions 152S and 152T because the rotation shaft 15 is easily fixed during a hole-drilling process. A hole-drilling process of the first and second horizontal lubricating holes 156*a* and 156*b* of Example 1 may be performed by inclining the first and second eccentric portions 152S and 152T with respect to a horizontal plane using a dedicated tool.

As illustrated in FIG. 8, according to calculation in a case where R410A is used as an example of the refrigerant, under a high compression rate (heavy load) condition during a heating operation or the like of the rotary compressor 1, the first and second eccentric portions 152S and 152T receive the maximum load due to a compression reaction force of the refrigerant at the time of rotation of about 270° from the dead center (when the eccentric direction is the same as a direction of the positions of the first and second vanes 127S and 127T) in the clockwise direction when viewed from below.

At this time, as illustrated in FIG. 7, the maximum load is applied in a 50° phase shifted direction from the eccentric direction (left direction in FIG. 7) of the first eccentric portion 152S in the clockwise direction. In addition, the first horizontal lubricating holes 156*a* formed in a 40° phase shifted direction in the counterclockwise direction from the eccentric direction (left direction in FIG. 7) of the first eccentric portion 152S are positioned in a direction of a neutral axis in which no stress is generated due to bending moment that acts on the rotation shaft 15. Hence, high tensile or compressive stress is not generated around the first horizontal lubricating hole 156*a* around which strength is low. Therefore, the strength of the rotation shaft 15 does not become insufficient due to the first horizontal lubricating hole 156*a*.

FIG. 9 is a view illustrating an acting state of a refrigerant compressive load on a rotation shaft of a rotary compressor in the related art which is disclosed in PTL 1 when a rotation angle of an eccentric portion of the rotation shaft becomes 270°. As illustrated in FIG. 9, in the rotary compressor in the related art which is disclosed in PTL 1, a first horizontal lubricating hole 956*a* is positioned in a 40° phase shifted direction from the neutral axis in the clockwise direction. In addition, a first horizontal lubricating hole 956*b* is positioned in a 50° phase shifted direction from the neutral axis in the counterclockwise direction. Therefore, high compressive stress is generated around the first horizontal lubricating holes 956*a* and 956*b* in the related art. High tensile or compressive stress is not generated around the first horizontal lubricating hole 156*a* of Example 1. Hence, an advantage is achieved in stress reduction, compared to the first horizontal lubricating holes 956*a* and 956*b* in the related art.

In addition, the first horizontal lubricating holes 156*a* have openings that are spaced apart by 180° from each other on a circumferential surface of the rotation shaft 15. Hence, the first horizontal lubricating holes 156*a* have uniform lubricating intervals compared to the first horizontal lubricating holes 956*a* and 956*b* in the related art. Further, the first horizontal lubricating holes 156*a* forma horizontal through hole and need the hole-drilling process only once and thus, a processing cost is reduced.

As above, the first horizontal lubricating hole 156*a* of Example 1 is described. The second horizontal lubricating hole 156*b* has the same acting effects as the first horizontal lubricating hole 156*a* and thus, description thereof is omitted.

As described above, the lubricating mechanism 159A of Example 1 which includes the lubricating pipe 16, the pump blade 157, the vertical lubricating holes 155 and 155*a*, the first and second horizontal lubricating holes 156*a* and 156*b*, and the like sucks up the lubricant oil stored in the lower section of the compressor housing 10 from the lubricating pipe 16. Accordingly, the sub-shaft unit 151, the compressing unit 12, the main-shaft unit 153, and the like are lubricated.

EXAMPLE 2

FIG. 10 is a side view of a lower section of a rotation shaft of Example 2. FIG. 11-1 is a cross-sectional view from below taken along line D-D in FIG. 10. FIG. 11-2 is a cross-sectional view from below taken along line E-E in FIG. 10. FIG. 12 is a view from below along arrow F in FIG. 10 and a view illustrating an acting state of a refrigerant compressive load on the rotation shaft when a rotation angle of an eccentric portion of the rotation shaft becomes 180°. FIG. 13 is a view from below along arrow F in FIG. 10 and a view illustrating an acting state of a refrigerant compressive load on the rotation shaft when a rotation angle of the eccentric portion of the rotation shaft becomes 270°.

As illustrated in FIG. 10, FIG. 11-1, and FIG. 12, first horizontal lubricating holes 156*c* of a lubricating mechanism 159B of Example 2 are formed on a side of the sub-shaft unit 151 of the first eccentric portion 152S of the rotation shaft 15 and are formed as a horizontal through hole of the rotation shaft 15 in the same direction as the eccentric direction (downward side in FIG. 10, FIG. 11-1, and FIG. 12) of the first eccentric portion 152S.

As illustrated in FIG. 10 and FIG. 11-2, second horizontal lubricating holes 156*d* of the lubricating mechanism 159B of Example 2 are formed on the side of the main-shaft unit 153 of the second eccentric portion 152T of the rotation shaft 15 and are formed as a horizontal through hole of the rotation shaft 15 in the same direction as the eccentric direction (upward side in FIG. 10, FIG. 11-2, and FIG. 12) of the second eccentric portion 152T.

As illustrated in FIG. 8, according to calculation in a case where R410A is used as the refrigerant, under a rated cooling condition of the rotary compressor 1, the first and second eccentric portions 152S and 152T receive the maximum load due to a compression reaction force of the refrigerant at the time of rotation of about 180° from the dead center (when the eccentric direction is the same as a direction of the positions of the first and second vanes 127S and 127T) in the clockwise direction when viewed from below.

At this time, as illustrated in FIG. 12, the maximum load is applied in a perpendicular direction (left direction in FIG. 12) to the eccentric direction (downward direction in FIG. 12) of the first eccentric portion 152S. In addition, the first horizontal lubricating holes 156*c* formed in the same direction as the eccentric direction of the first eccentric portion 152S are positioned in the direction of a neutral axis in which no stress is generated due to bending moment that acts on the rotation shaft 15. Hence, concentrated tensile or compressive stress is not generated around the first horizontal lubricating hole 156*c* around which strength is low.

In addition, as illustrated in FIG. 8, under a high compression rate (heavy load) condition during a heating operation or the like of the rotary compressor 1, the first and second eccentric portions 152S and 152T receive the maximum load due to a compression reaction force of the refrigerant at the time of rotation of about 270° from the dead center (when the eccentric direction is the same as a direction of the positions of the first and second vanes 127S and 127T) in the clockwise direction when viewed from below.

At this time, as illustrated in FIG. 13, the maximum load is applied in a 50° phase shifted direction from the eccentric direction (left direction in FIG. 13) of the first eccentric portion 152S in the clockwise direction. In addition, the first horizontal lubricating holes 156*c* formed in the same direction as the eccentric direction of the first eccentric portion 152S are positioned in a 40° phase shifted direction from the neutral axis in the clockwise direction.

As illustrated in FIG. 9, in the rotary compressor in the related art which is disclosed in PTL 1, the first horizontal lubricating hole 956*a* is positioned in a 40° phase shifted direction from the neutral axis in the clockwise direction. In addition, a first horizontal lubricating hole 956*b* is positioned in a 50° phase shifted direction from the neutral axis in the counterclockwise direction. Therefore, the same compressive stress is generated to one first horizontal lubricating hole 156*c* of Example 2 as that to the first horizontal lubricating hole 956*a* in the related art. However, tensile stress generated around the other first horizontal lubricating hole 156*c* of Example 2 is less than the compressive stress generated around the first horizontal lubricating hole 956*b* in the related art, and thus the first horizontal lubricating holes 156*c* have advantages in stress reduction.

As above, the first horizontal lubricating hole 156*c* is described. The second horizontal lubricating hole 156*d* has the same acting effects as the first horizontal lubricating hole 156*c* and thus, description thereof is omitted.

As described above, the lubricating mechanism 159B of Example 2 which includes the lubricating pipe 16, the pump blade 157, the vertical lubricating holes 155 and 155*a*, the first and second horizontal lubricating holes 156*c* and 156*d*, and the like sucks up the lubricant oil stored in the lower section of the compressor housing 10 from the lubricating pipe 16. Accordingly, the sub-shaft unit 151, the compressing unit 12, the main-shaft unit 153, and the like are lubricated.

EXAMPLE 3

FIG. 14 is a view illustrating positions of horizontal lubricating holes of Example 3. As illustrated in FIG. 14, first horizontal lubricating holes 156*e* of Example 3 are formed on the side of the sub-shaft unit 151 of the first eccentric portion 152S of the rotation shaft 15. The first horizontal lubricating holes 156*e* are formed as a horizontal through hole of the rotation shaft 15 in a 20° phase shifted direction (20° phase shifted direction from the neutral axis) from the eccentric direction (leftward side in FIG. 14) of the first eccentric portion 152S in a direction opposite to the rotating direction (clockwise direction in FIG. 14 because the view is seen from below) of the rotation shaft 15.

Therefore, as illustrated in FIG. 9, in the rotary compressor in the related art which is disclosed in PTL 1, the first horizontal lubricating holes 956*a* and 956*b* are positioned in a 40°-or-more phase shifted direction from the neutral axis. In contrast, the first horizontal lubricating hole 156*e* of Example 3 is close to the neutral axis and tensile or compressive stress generated around the hole is small and thus, an advantage is achieved in stress reduction.

EXAMPLE 4

FIG. 15 is a view illustrating positions of horizontal lubricating holes of Example 4. As illustrated in FIG. 15, first horizontal lubricating holes 156*g* of Example 4 are formed on the side of the sub-shaft unit 151 of the first eccentric portion 152S of the rotation shaft 15. Further, the first horizontal lubricating holes 156*g* are formed as a horizontal through hole of the rotation shaft 15 in a 60° phase shifted direction (20° phase shifted direction from the neutral axis) from the eccentric direction (leftward side in FIG. 15) of the first eccentric portion 152S in a direction opposite to the rotating direction (clockwise direction in FIG. 15 because the view is seen from below) of the rotation shaft 15.

Therefore, as illustrated in FIG. 9, in the rotary compressor in the related art which is disclosed in PTL 1, the first horizontal lubricating holes 956*a* and 956*b* are positioned in a 40°-or-more phase shifted direction from the neutral axis. In contrast, the first horizontal lubricating holes 156*g* of Example 4 are close to the neutral axis. Accordingly, tensile or compressive stress generated around the hole is small and thus, an advantage is achieved in stress reduction.

EXAMPLE 5

FIG. 16 is a view illustrating positions of horizontal lubricating holes of Example 5. As illustrated in FIG. 16, first horizontal lubricating holes 156*i* of Example 5 are formed on the side of the sub-shaft unit 151 of the first eccentric portion 152S of the rotation shaft 15. The first horizontal lubricating holes 156*i* are formed as a horizontal through hole of the rotation shaft 15 in a 70° phase shifted direction (30° phase shifted direction from the neutral axis) from the eccentric direction (leftward side in FIG. 16) of the first eccentric portion 152S in a direction opposite to the rotating direction (clockwise direction in FIG. 16 because the view is seen from below) of the rotation shaft 15.

Therefore, as illustrated in FIG. 9, in the rotary compressor in the related art which is disclosed in PTL 1, the first horizontal lubricating holes 956*a* and 956*b* are positioned in a 40°-or-more phase shifted direction from the neutral axis. In contrast, the first horizontal lubricating hole 156*g* of Example 4 is close to the neutral axis. Accordingly, tensile or compressive stress generated around the hole is small and thus, an advantage is achieved in stress reduction.

EXAMPLE 6

FIG. 17 is a view illustrating positions of horizontal lubricating holes of Example 6. As illustrated in FIG. 17, first horizontal lubricating holes 156*k* of Example 6 are formed on the side of the sub-shaft unit 151 of the first eccentric portion 152S of the rotation shaft 15. The first horizontal lubricating holes 156*k* are formed as a horizontal through hole of the rotation shaft 15 in a 80° phase shifted direction (40° phase shifted direction from the neutral axis) from the eccentric direction (leftward side in FIG. 17) of the first eccentric portion 152S in a direction opposite to the rotating direction (clockwise direction in FIG. 17 because the view is seen from below) of the rotation shaft 15.

As illustrated in FIG. 9, in the rotary compressor in the related art which is disclosed in PTL 1, the first horizontal lubricating hole 956*a* is positioned in a 40° phase shifted direction from the neutral axis in the clockwise direction. In addition, a first horizontal lubricating hole 956*b* is positioned in a 50° phase shifted direction from the neutral axis in the counterclockwise direction. Therefore, the same compressive stress is generated to one first horizontal lubricating hole 156*k* of Example 6 as that to the first horizontal lubricating hole 956*a* in the related art. However, tensile stress generated around the other first horizontal lubricating hole 156*k* of Example 6 is less than the compressive stress generated around the first horizontal lubricating hole 956*b* in the related art and thus the first horizontal lubricating holes 156*k* have advantages in stress reduction.

EXAMPLE 7

FIG. 18 is a view illustrating positions of horizontal lubricating holes of Example 7. As illustrated in FIG. 18, first horizontal lubricating holes 156*m* of Example 7 are formed on the side of the sub-shaft unit 151 of the first eccentric portion 152S of the rotation shaft 15. The first horizontal lubricating holes 156*m* are formed as a horizontal through hole of the rotation shaft 15 in a 10° phase shifted direction (50° phase shifted direction from the neutral axis) from the eccentric direction (leftward side in FIG. 18) of the first eccentric portion 152S in the rotating direction (clockwise direction in FIG. 18 because the view is seen from below) of the rotation shaft 15.

As illustrated in FIG. 9, in the rotary compressor in the related art which is disclosed in PTL 1, the first horizontal lubricating hole 956*a* is positioned in a 40° phase shifted direction from the neutral axis in the clockwise direction. In contrast, the first horizontal lubricating hole 956*b* is positioned in a 50° phase shifted direction from the neutral axis in the counterclockwise direction. Therefore, the same compressive stress is generated around the other first horizontal lubricating hole 156*m* of Example 7 as that to the first horizontal lubricating hole 956*b* in the related art. However, tensile stress generated around one first horizontal lubricating hole 156*m* of Example 7 becomes greater than the compressive stress generated around the first horizontal lubricating hole 956*a* in the related and thus the first horizontal lubricating holes 156*m* are disadvantageous in stress reduction.

A rotation angle in which the maximum load due to the compression reaction force of the refrigerant is applied to the first and second eccentric portions 152S and 152T of the rotation shaft 15 is about from 180° to 270° although the rotation angle is changed in accordance with an operation range set for the rotary compressor 1. Hence, as described in Examples 1 to 6, the direction in which the vertical lubricating holes may be formed is between the same direction as the eccentric direction of the first and second eccentric portions 152S and 152T and a 80° phase shifted direction from the same direction as the eccentric direction in a direction opposite to the rotating direction of the rotation shaft 15.

In addition, in Examples 1 to 6, the first and second horizontal lubricating holes 156*a*, 156*b*, 156*c*, 156*d*, 156*e*, 156*g*, 156*i*, 156*k* are the horizontal through holes of the rotation shaft 15. However, in a case where the horizontal through hole is not needed because of lubricating performance, the horizontal lubricating holes may be provided as a horizontal lubricating hole on only one side, which communicates with the vertical lubricating hole 155.

REFERENCE SIGNS LIST

1 rotary compressor
10 compressor housing

11 motor
12 compressing unit
15 rotation shaft
16 lubricating pipe
16*a* inlet
25 accumulator
31S first low-pressure communication tube
31T second low-pressure communication tube
101 first through hole
102 second through hole
104 first inlet pipe
105 second inlet pipe
107 discharge pipe (discharge unit)
111 stator
112 rotor
12S first compressing unit
12T second compressing unit
121S first cylinder (cylinder)
121T second cylinder (cylinder)
122S first side-flared portion
122T second side-flared portion
123S first cylinder inner wall (cylinder inner wall)
123T second cylinder inner wall (cylinder inner wall)
124S first spring bore
124T second spring bore
125S first annular piston (annular piston)
125T second annular piston (annular piston)
127S first vane (vane)
127T second vane (vane)
128S first vane groove (vane groove)
128T second vane groove (vane groove)
129S first pressure guiding-in path
129T second pressure guiding-in path
130S first operation chamber (operation chamber)
130T second operation chamber (operation chamber)
131S first inlet chamber (inlet chamber)
131T second inlet chamber (inlet chamber)
133S first compression chamber (compression chamber)
133T second compression chamber (compression chamber)
135S first inlet hole (inlet hole)
135T second inlet hole (inlet hole)
136 refrigerant path
140 intermediate partition plate
151 sub-shaft unit
152S first eccentric portion (eccentric portion)
152T second eccentric portion (eccentric portion)
153 main-shaft unit
155 vertical lubricating hole
155*a* vertical lubricating hole
155*b* vertical fitting hole
156*a*, 156*c* first horizontal lubricating hole (horizontal lubricating hole)
156*b*, 156*d* second horizontal lubricating hole (horizontal lubricating hole)
157 pump blade
157*a* blade portion
157*b* base portion
159A, 159B lubricating mechanism
160S lower end plate (end plate)
160T upper end plate (end plate)
161S sub-bearing unit
161T main-bearing unit
170S lower muffler cover
170T upper muffler cover
175 penetrating bolt
180S lower muffler chamber
180T upper muffler chamber
190S first outlet (outlet)
190T second outlet (outlet)
200S first discharge valve
200T second discharge valve
201S first discharge valve cover
201T second discharge valve cover
252 accumulator holder
253 accumulator band
255 system connecting pipe
R opening

The invention claimed is:

1. A rotary compressor comprising:

a vertically-positioned airtight compressor housing, in an upper section of which a discharge path of a refrigerant is provided and in a lower section of which an inlet path of the refrigerant is provided and lubricant oil is stored;

a compressing unit that is disposed in the lower section of the compressor housing and that compresses the refrigerant sucked in via the inlet path and discharges the refrigerant from the discharge path;

a motor that is disposed in the upper section of the compressor housing and drives the compressing unit via a rotation shaft; and a lubricating mechanism that supplies the lubricant oil stored in the lower section of the compressor housing to a sliding portion of the compressing unit through a vertical lubricating hole and a horizontal lubricating hole of the rotation shaft, wherein in cross sectional view of the rotation shaft, a cutting plane of which is perpendicular to a center axis of the rotation shaft, the horizontal lubricating hole of the lubricating mechanism extends in a direction different from an eccentric direction of an eccentric portion provided on the rotation shaft, the eccentric portion causing an annular piston of the compressing unit to make an orbital motion in a cylinder, and is formed between the eccentric direction of the eccentric portion and an 80° C. phase shifted direction from the eccentric direction in a direction opposite to the rotation direction of the rotation shaft.

2. The rotary compressor according to claim 1, wherein the horizontal lubricating hole penetrates both sides of the rotation shaft in a radial direction of the rotation shaft.

3. The rotary compressor according to claim 1, wherein a center axis of the horizontal lubricating hole crosses the eccentric direction, and extends between the eccentric direction and the 80° C. phase shifted direction, in the cross sectional view.

* * * * *